United States Patent [19]

Parkins

[11] Patent Number: 4,697,789

[45] Date of Patent: Oct. 6, 1987

[54] LOCKSMITH'S WEDGE FOR AUTOMOBILE DOORS

[76] Inventor: Donald L. Parkins, 846 South 35th Avenue, Omaha, Nebr. 68105

[21] Appl. No.: 901,403

[22] Filed: Aug. 28, 1986

[51] Int. Cl.[4] ..... G66F 15/00

[52] U.S. Cl. ..... 254/104

[58] Field of Search ..... 254/104; 29/253, 270, 29/267

[56] References Cited

U.S. PATENT DOCUMENTS

| | | | |
|---|---|---|---|
| 2,084,417 | 6/1937 | Tomkinson | 254/104 |
| 2,205,614 | 6/1940 | Bashe | 254/104 |
| 2,239,433 | 4/1941 | Urbain | 254/104 |
| 3,149,414 | 9/1964 | Bell | 254/104 X |
| 3,185,442 | 5/1965 | Hemphill | 254/104 |

*Primary Examiner*—Frederick R. Schmidt
*Assistant Examiner*—Steven P. Schad
*Attorney, Agent, or Firm*—George R. Nimmer

[57] ABSTRACT

A monolithic block, preferably singularly constructed of moderately resiliently compressible and flexible resinous material, has a generally horizontal base surface, two angular ends including a left-wedge of about 30° to 40° and a right-wedge of about 10° to 20°, and an upper-medial surface terminating at fulcrums alternatively abuttable against an automobile door pane. Selectable employment of an angular end will wedge sufficient space between the transparent fragile pane and the opaque casing of an automobile door to permit insertion of some conventional locksmith's probing tool for unlocking the automobile door, and without appreciable danger of cracking or damaging the fragile door pane.

6 Claims, 5 Drawing Figures

FIG. 3
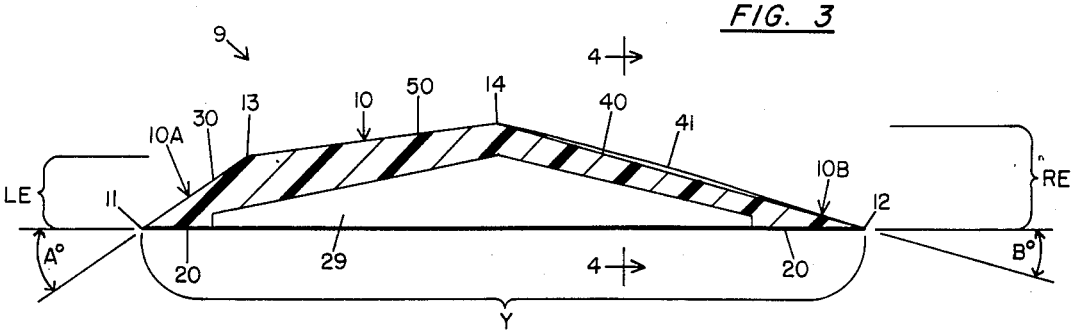
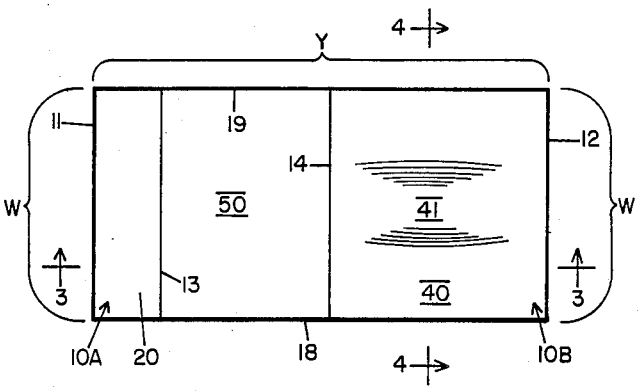
FIG. 1
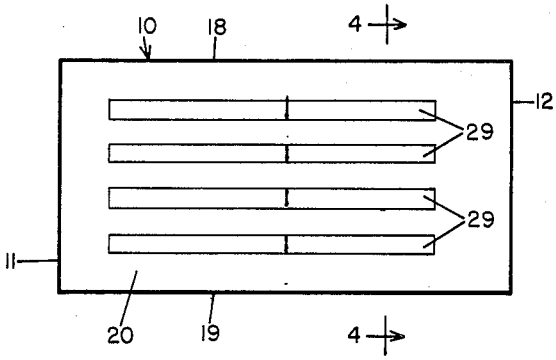
FIG. 2
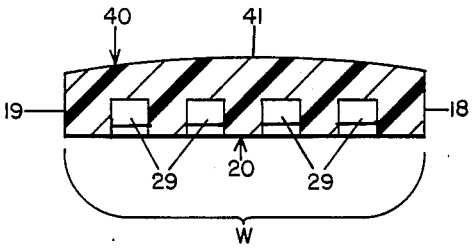
FIG. 4
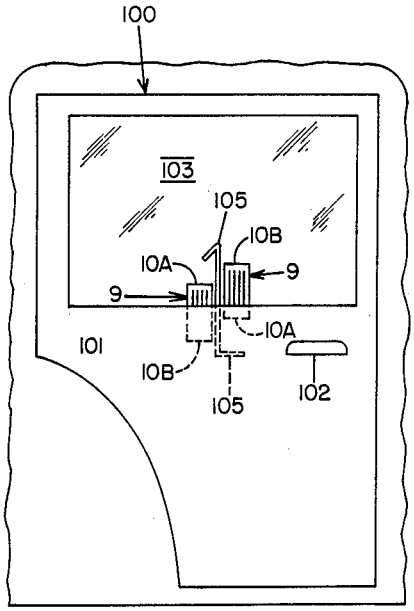
FIG. 5

LOCKSMITH'S WEDGE FOR AUTOMOBILE DOORS

BACKGROUND OF THE INVENTION

Drawing FIG. 5 schematically depicts the external side of some conventional automobile door 100 comprising a transparent (e.g. glass) pane 103 that is surroundably supported by an internally channeled hollow casing 101 having handle 102. Whenever automobile owners find themselves outside their locked automobile and with the door key inadvertently left inside the automobile, a locksmith can be summoned to unlock the door (100) from the external side. Trained locksmiths can so unlock the door by adroitly inserting and maneuvering some probing tool (e.g. 105) between the door pane (103) and casing (101) and toward the door lockrods located below the pane. For many automobiles, insufficient space exists between the door pane and casing to permit insertion of a locksmith's probing tool therebetween. In such situations, locksmiths have attempted to insert a wedging tool between the door pane and casing in order to provide entry space for the probing tool. However, wedging tools of the prior art are unsatisfactory in that they tend to crack or damage the fragile pane before sufficient entry space is provided for the probing tool.

OBJECT OF THE INVENTION

It is accordingly the general objective of the present invention to provide a locksmith's wedge tool that is adapted to provide sufficient space between the pane and casing of an automobile door to permit insertion of some conventional locksmith's probing tool. It is an ancillary objective to wedge a sufficient space between the pane and casing of various types of automobile door construction and without cracking or damaging the relatively fragile door pane.

GENERAL STATEMENT OF THE INVENTION

With the aforementioned general objective in view, and together with specific and ancillary objectives which will become more apparent as this description proceeds, the locksmith's wedge tool of the present invention is of monolithic block form that is preferably singularly predominately formed of moderately resiliently compressible and flexible resinous material, such block extending longitudinally along a horizontal base surface between two transversely extending ends for said block, the block at the two transversely extending ends including an angular left-wedge of about 30° to 40° (defined by the base surface and an inclined first surface) and an angular right-wedge of about 10° to 20° (defined by the base surface and an inclined second surface), an upper-medial third surface intervening between the left-wedge and right-wedge and terminally defining fulcrums alternatively abuttable against the door pane, and together with other optional desireable features which will be pointed out in the ensuing detailed description.

BRIEF DESCRIPTION OF THE DRAWING

In the drawing, wherein like characters refer to like parts in the several views, and in which:

FIG. 1 is a top plan view of a representative embodiment (9) of the locksmith's wedge tool of the present invention;

FIG. 2 is a bottom plan view of the FIG. 1 representative embodiment;

FIG. 3 is a longitudinally extending sectional elevational view taken along line 3—3 of FIG. 1;

FIG. 4 is a transversely extending sectional elevational view taken along lines 4—4 of FIGS. 1-3; and FIG. 5 is directed to the aforedescribed schematic view and amplified to show alternative usages of a locksmith's wedge tool (e.g. 9) of the present invention.

DETAILED DESCRIPTION OF THE INVENTION

Representative embodiment 9 of the locksmith's wedge tool consists of a monolithic and predominately non-metallic block 10 extending longitudinally (Y) along a substantially rectangular and horizontal base surface 20 that is longitudinally bounded by two transverse ends of width W and including left-end 11 and right-end 12. Moderately resiliently compressible and flexible resinous materials are preferred for the monolithic block such as high density polyethylene material.

In addition to said two ends 11 and 12, the four transversely extending (W) block edges include:

a left-edge 13 having a left-elevational value (LE) overlying base surface 20, and a right-edge 14 having a right-elevational value (RE) overlying base surface 20.

RE preferably exceeds LE by about 1/5 to $\frac{1}{3}$, with $\frac{1}{4}$ being preferred.

Block 10 includes two alternatively employable (e.g. FIG. 5) acutely angled wedges 10A and 10B, namely:

(a) left-wedge 10A having an angular value (A°) within the range of substantially 30° to 40° and provided by base surface 20 and inclined upper-left first surface 30 merging at lineal left-end 11, and (b) right-wedge 10B having an angular value (B°) in the range of substantially 10° to 20° and provided by base surface 20 and inclined upper-right second surface 40 merging at lineal right-end 12.

The substantially rectangular and constant width (W) upperleft first surface 30 slopes upwardly rightwardly from left-end 11 to left-edge 13, and the substantially rectangular and constant width (W) upper-right second surface 40 slopes upwardly leftwardly from right-end 12 to right-edge 14. Second surface 40 has a finite second-area value that is typically at least twice, and perhaps triple, that of the first surface (30) finite first-area. A substantially rectangular and constant width (W) upper-medial third surface 50, having its two transverse terminii at lofty edges 13 and 14, intervenes between surfaces 30 and 40. Third surface 50, which terminates at edge fulcrums 13 and 14 alternatively abuttable against an automobile door pane (103), has a finite third-area value that is typically intermediate to said first-area and second-area values.

In addition to the aforedescribed four surfaces 20, 30, 40, and 50, the surface boundary of block 10 is completed by a pair of substantially parallel planar upright surfaces (18, 19) respectively substantially perpendicularly intersecting each of said surfaces 20, 30, 40, and 50. Accordingly, for embodiment 9, said constant width (W) exists between the upright leadward surface 18 and upright trailward surface 19 of monolitic tool 9.

In order to enhance the tool resiliency and flexibility, it is desireably provided with a plurality of longitudinally extending and substantially parallel cutout portions (e.g. grooves 29) respectively communicating with the base surface only of monolitic resinous block 10. Such cutout grooved portions (29) inherently effect a slightly concave juncture between base surface 20 and the respective upright surfaces (18, 19).

As seen in FIGS. 1 and 3, transversely extending central portions of inclined second surface 40 are slightly convex (41). However, as best seen in FIG. 4, such convexity has its highest amplitude substantially midway right-end 12 and right-edge 14.

Although having already been alluded to, operation of the locksmith's wedge tool (e.g. 9) might be summarized as follows, and with reference to FIG. 5. For wedging a space between the automobile door pane (103) and casing (101) to permit downward insertion therebetween of a probing tool (e.g. 105), one should first attempt usage of the 10°-20° right-wedge (10B) because this small angle (B°) wedge will practically never damage the pane. In this mode, the locksmith views base surface 20 and pushes downwardly on left-wedge 10A; that is accompanied by slidably abutting second surface 40 against pane 103 until right-wedge 10B is deeply obscured by door casing 101. Then, the locksmith horizontally presses left-wedge 10A toward pane 103 whereby the block acts as a lever with right-edge 14 being a fulcrum against pane 103. Accordingly, a space is provided to permit downward insertion of a conventional probing tool (e.g. 105) wielded by the locksmith's other hand. Convexity 41 augments said spacing.

In some types of automobile doors, the pane is supported by an unusually thick channel which does not permit deep insertion of the preferred small angle wedge (e.g. 10B). For such types automobile doors, and as alternatively alluded to in FIG. 5, reliance must instead be made upon the higher angled wedge (e.g. 10A). In this alternative mode, the locksmith views base surface 20 and pushes downwardly on right-wedge 10A; this is accompanied by slidably abutting first surface 30 against pane 103 until left-wedge 10A strikes the pane channeling positioned slightly below the door casing opening. Then, the locksmith horizontally presses right-wedge 10B toward pane 103 whereby the block acts a lever with left-edge 13 being a fulcrum against pane 103. Accordingly, a space is provided to permit downward insertion of a conventional probing tool, which is wielded by the locksmith's other hand.

A particularly apt locksmith's wedge tool is provided by molding a block entirely from high-density polyethylene according to the following parameters:

(a) a rectangular planar base surface (20) that is 2.4 inches wide (i.e. along ends 11 and 12) and 4.8 inches long (i.e. between ends 11 and 12);
(b) a rectangular planar first surface (30) that is said 2.4 inches wide and has a first-area of 2.2 square inches;
(c) a rectangular second surface (40) that is said 2.4 inches wide and has a second-area value of 6.0 square inches;
(d) a rectangular planar third surface (50) that is said 2.4 inches wide and has a third-area value of 4.1 square inches;
(e) a left-elevational value (LE) of 0.5 inch;
(f) a right-elevational value (RE) of 0.7 inch;
(g) four grooves (29), each having rectangular measurements at base surface (20) of 3.6 inch by 0.2 inch and an apexial height of 0.5 inch; and
(h) a weight of 58 grams, all provided by said high density polyethylene structural material.

Such parameters meet the aforestated objectives for the locksmith's wedge tool and including too a tool having a surface that is desireably moderately slick and resistant to being fouled by dirt, metallic filings, and other contaminants.

From the foregoing the construction and operation of the locksmith's wedge tool will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

What is claimed is as follows:

1. Locksmith's wedge tool for prying a working opening between the transparent pane and the casing of an automobile door, said tool wholly consisting of a monolithic and predominately non-metallic block extending longitudinally along a generally horizontal planar base surface that is longitudinally bounded by two transverse ends including a left-end and a right-end, said monolithic block comprising:

(A) a wholly planar upper-left first surface having a finite first-area and intersecting said left-end at an angular value selectable from the range of substantially 30° to 40°, whereby said monolithic block includes an angular left-wedge, having a linearly extending apex at said block left-end;
(B) an upper-right second surface having a finite second-area and intersecting said right-end at an angular value selectable from the range of substantially 10° to 20°, whereby said monolithic block includes an angular right-wedge having a linearly extending apex at said block right-end, and central transversely extending portions of said second surface being slightly convex;
(C) an upper-medial third surface intersecting said first surface along a transversely extending left-edge linear fulcrum that loftily overlies said base surface, said third surface extending upwardly from said left-edge and intersecting said second surface along a transversely extending right-edge linear fulcrum that overlies said base surface; and
(D) an upright leadward surface and an upright trailward surface, said leadward and trailward surfaces respectively and independently linearly intersecting said first, said second, and said third surfaces.

2. The tool of claim 1 wherein the second-area exceeds the first-area by a ratio of at least three.

3. The locksmith's wedge tool of claim 1 wherein the block predominately comprises moderately resiliently compressible resinous material.

4. The tool of claim 3 wherein the entire monolitic block is singularly constructed of resinous material.

5. The locksmith's wedge tool of claim 4 wherein said monolithic block is provided with centrally cutout portions communicating only at said base surface.

6. The tool of claim 5 wherein the centrally cutout portions take the form of longitudinally extending parallel grooves; and wherein, at said base surface, the junctures between the leadward and trailward surfaces are slightly convex.

* * * * *